US007225747B2

(12) United States Patent
Friman et al.

(10) Patent No.: US 7,225,747 B2
(45) Date of Patent: Jun. 5, 2007

(54) CONTROL OF THREAD FEED FOR A SEWING MACHINE

(75) Inventors: Bertil Friman, Tenhult (SE); Henrik Eklund, Huskvarna (SE)

(73) Assignee: VSM Group AB, Huskvarna (SE)

( * ) Notice: Subject to any disclaimer, the term of this patent is extended or adjusted under 35 U.S.C. 154(b) by 17 days.

(21) Appl. No.: 11/079,312

(22) Filed: Mar. 15, 2005

(65) Prior Publication Data

US 2005/0223958 A1 Oct. 13, 2005

(30) Foreign Application Priority Data

Mar. 15, 2004 (SE) ..... 0400633

(51) Int. Cl.
*D05B 47/04* (2006.01)

(52) U.S. Cl. ..... 112/475.01; 112/254

(58) Field of Classification Search ..... 112/475.01, 112/254, 278, 226, 470.04, 255
See application file for complete search history.

(56) References Cited

U.S. PATENT DOCUMENTS

| | | | | |
|---|---|---|---|---|
| 4,301,757 A | | 11/1981 | Tonomura | |
| 4,408,554 A | | 10/1983 | Takiguchi et al. | |
| 4,566,396 A | | 1/1986 | Sakuma et al. | |
| 4,702,185 A | * | 10/1987 | Hanyu et al. | 112/254 |
| 4,967,679 A | | 11/1990 | Hara et al. | |
| 4,993,337 A | | 2/1991 | Matsubara | |
| 5,020,461 A | * | 6/1991 | Hanyu et al. | 112/278 |
| 5,105,750 A | * | 4/1992 | Horie | 112/302 |
| 5,174,133 A | * | 12/1992 | Kawase et al. | 66/57 |
| 5,315,945 A | * | 5/1994 | Nakano | 112/470.01 |
| 6,012,405 A | | 1/2000 | Melton et al. | |

FOREIGN PATENT DOCUMENTS

| | | |
|---|---|---|
| DE | 3102048 C2 | 7/1989 |
| GB | 2008631 A | 6/1979 |
| JP | 2172495 | 7/1990 |

(Continued)

*Primary Examiner*—Danny Worrell
(74) *Attorney, Agent, or Firm*—Venable LLP; Eric J. Franklin

(57) ABSTRACT

A sewing machine including an upper thread supply to a needle, a loop taker accommodating a bobbin for a bottom thread, a drive unit which through coupling elements affects a number of mechanical elements, of which the needle is one of the mechanical elements, to perform synchronous cyclic movements between themselves, wherein the needle during its movement in cooperation with the loop taker performs stitches on a sewing material which is transported between upper thread and bottom thread, by means of a take-up lever which in each stitch pulls tight a knot, which is formed in the sewing material by the upper thread and the bottom thread in cooperation, wherein the sewing machine includes a sensor function that detects a deviation between a set value for a point of time at which a predetermined value for a tensile force in the upper thread is reached at pull tight of a knot and an actual value at the time of point where the predetermined value of the tensile force in the upper thread is reached at pull tight of the knot, and wherein the sewing machine includes control means for the control of the means being used to supply upper thread to the needle, so that the deviation between a first position and a second position is brought to zero.

30 Claims, 3 Drawing Sheets

FOREIGN PATENT DOCUMENTS

| | | |
|---|---|---|
| JP | 2177998 | 7/1990 |
| JP | 4073091 | 3/1992 |
| JP | 5212183 | 8/1993 |
| JP | 6063265 | 3/1994 |
| JP | 06134163 A | 5/1994 |
| JP | 6269587 | 9/1994 |
| JP | 185170 | 7/1995 |
| WO | WO 00/68483 A1 | 11/2000 |

* cited by examiner

CONTROL OF THREAD FEED FOR A SEWING MACHINE

TECHNICAL FIELD

The present invention relates to a sewing machine and a method for control of a supply of thread for each stitch for the sewing machine. Particularly, the invention shows a device for the detection of a deviation between a calculated amount of thread consumed per stitch and the in reality consumed amount of thread. Further, the invention discloses means for use of the detected deviation as a base for the control of the thread feed, either be means of portioning out of upper thread for each stitch, or through friction braking of the upper thread as well as a possibility for the user to select between thread portioning out or friction braking in dependence of the desired field of use of the sewing machine.

BACKGROUND OF THE INVENTION

To establish a seam on a fabric there exists, today, on the market a number of devices of different designs for performing lock stitches. On common home sewing machines an upper thread and a bottom thread on a bobbin in cooperation with a needle is used, in a known way, to bring the upper thread to perform a lock stitch on the fabric, which is sewn on the sewing machine.

A correct relation between the length of the upper thread and the length of the bottom thread of a stitch is desirable to accomplish a seam that looks decorative and holds a high quality. The proportion between the length of the upper thread and the bottom thread of each stitch depends on the relation between the tension of the upper thread and the bottom thread, respectively, during the forming of a knot that is made by upper thread and bottom thread and which constitutes a lock for a stitch in the seam.

To obtain the desired quality of a stitch, it is desirable that the knot of a stitch can securely be placed at the desired location in relation to the fabric. Usually, an optimal location of the knot is in the middle of the fabric as seen in a cross section of the extension of the fabric.

In prior art it is known to automatically adjust the present thread tension of the upper thread based on thread consumption of former stitches of the seam. Such a device is disclosed, as an example, in document U.S. Pat. No. 6,012,405. In this device the real thread consumption of the upper thread is measured be means of a decoder for consumed thread length after a completed stitch, whereby this information about real thread consumption for an already performed stitch is used to adjust the thread tension of a subsequent stitch to accomplish a correct relation of thread lengths between upper thread and bottom thread. This and other similar solutions presupposes that the amount of upper thread required for a present stitch is known in advance.

Document U.S. Pat. No. 4,967,679 discloses a solution to attain automatic control of thread feed, wherein a sewing machine for straight seams utilizes to thread portioning out in accordance with a requisite amount of upper thread, and which adjusts the thread tension of the upper thread at zigzag sewing. The thread portioning out of this solution is mechanically driven, wherein rolls which drives the thread are rotated synchronically with the driving mechanical members of the sewing machine. At zigzag sewing the thread tension is electrically set according to a manually predetermined value. In this described solution the thread supply is indirectly supervised and not through a direct reading of a prevailing deviation between actual thread consumption and a predetermined thread consumption per stitch.

During sewing, the calculated consumption of upper thread sometimes deviates from the actual consumption, which for example can depend on that the displacement of the fabric differ from the theoretically accurate. If, e.g. it is desired to portion out the thread by means of a thread portioner, automatically portioning out a calculated amount per stitch, instead of adjusting the tensile force in the upper thread by means of conventional friction braking, a precise information about a deviation between a calculated and an actual thread consumption is required already during the present stitch. An object with the present invention is to provide a device and a method to obtain this desired information.

BRIEF DESCRIPTION OF THE INVENTION

According to one aspect of the present invention there is provided a sewing machine including

- means for supplying a needle with an upper thread
- a loop taker accommodating a bobbin for a bottom thread,
- a drive unit affecting through coupling elements, partly the needle to perform a reciprocating movement, partly a mechanical element to perform a movement synchronous with the needle, wherein the needle during its movement in cooperation with the loop taker performs stitches on a sewing material, which is transported forwards between the upper thread and the bottom thread, by, for each stitch, pulling tight a knot, which is formed in the sewing material by the upper thread and the bottom thread in cooperation, wherein the sewing machine includes a sensor function which detects a deviation between:

- a position A of the mechanical element at a set value of a point of time where a predetermined value of a tensile force in the upper thread is reached at pull tight of a knot and
- a position B of the mechanical element at an actual value of the point of time where the predetermined value of the tensile force in the upper thread is reached at pull tight of the knot, and wherein the sewing machine comprises a control member to control the means used to provide the needle with upper thread, so that the absolute value of the deviation, i.e. $|A-B|$ is minimized.

According to a second aspect of the invention there is provided a method according to the independent method claim.

The means for providing the needle with upper thread are composed, as an example, of a member for portioning out of a required amount of thread per stitch or of an upper thread friction braking member setting a correct tensile force in the upper thread during each stitch by exerting a friction force applied to the thread.

Usually included in the mechanical elements affecting the needle to perform the forwards and backwards movement is a sewing machine shaft, for example a drive shaft rotated by the drive unit of the sewing machine or of an auxiliary shaft brought to rotation by the drive shaft. Any of these mentioned shafts can be utilized as the mechanical element, which performs said movement synchronously with the needle, whereby the mechanical element in this case performs a rotating cyclic movement. In alternative embodiments, the mechanical element can be represented by a linearly moving element or of a mechanical element oscillating about a point of rotation, whereby in both these cases these mechanical elements are brought to their cyclic movement by the drive unit of the sewing machine.

The detection of the point of time at which the predetermined tensile force in the upper thread is reached is carried out by use of a member which detects the point of time of a rapid acceleration of the tensile force in the upper thread, which indicates the point of time of pull tight of the knot of a stitch. Such a member can be established in a number of ways, e.g. through the use of a thread transfer spring, about which the upper thread is hooked. At a very rapid tensile force acceleration, this spring is quickly brought to a new position, when it is stretched by the upper thread. On a detection of when the change of the position of the thread transfer spring occurs, a value of the point of time t of the pull tight of the knot is obtained. The point of time when the predetermined tensile force in the upper thread occurs can hereby be established by way of, as an example, dimensioning the spring force of the thread transfer spring through its design, choice of material, etc.

The position A of the mechanical element, when this in one embodiment is constituted of a rotating shaft, comprises that the shaft takes an angle of rotation A, where a mark on the shaft coincides with a fixedly defined mark adjacent to the rotating shaft. The position B of the mechanical element corresponds to the real angle of rotation, which the shaft holds in relation to the fixed mark at the very moment when the predetermined tensile force is detected.

In the sewing machine, when a take-up lever, through which the upper thread is thread, is displaced in one direction for the pull tight of the knot, the upper thread will become stretched. The angle of rotation A of the rotating shaft when the take-up lever stretches the upper thread upon a correctly fed out amount of thread is a known parameter. By a detection of the angle of rotation B (which in this example is composed by the position B), when the thread is stretched and then compare the real angle B with the angle A, of which the thread should have been stretched for a correctly amount of fed out thread, a measure of the deviation between a calculated and a real thread consumption is obtained. Thus, the invention makes it possible to detect if a correct amount of thread, to small amount of thread, or to big amount of thread, is supplied.

One part of the invention is that it is possible to obtain a measure of how much the real thread consumption deviates from the theoretically correct, whereby it will become possible to compensate for the deviation by means of an adjustment of the amount of thread fed out. The correction of the deviation is carried out by way of a device for thread portioning out being controlled to minimize the deviation or that a device for friction braking is controlled to minimize the deviation. The deviation from the theoretically calculated thread consumption can e.g. depend on different elasticity of the thread being used or on varying feed efficiency at transport of the sewing material. By the feature: "minimizing the deviation", herein, refers to the absolute value of the deviation independent of whether the deviation is positive or negative.

A great advantage with the invention is that it becomes possible to use an automatic device for thread portioning out, i.e. a device, which delivers a certain amount of thread per stitch. Earlier it has been problematic to utilize such a thread portioning out, when no method has been provided to obtain information about deviation between theoretical and actual thread consumption of a present stitch, i.e. of the stitch, which at present is being sewn by the machine.

A substantial advantage with the present invention is that it becomes possible to select among two methods for supply of upper thread to the needle adapted to the type of seam, method of sewing and sewing material which at present is used and for both alternatives of supply have the possibility to control the deviation between actual and calculated thread consumption towards zero in each stitch.

One way to carry out the thread portioning out is to use a stepmotor, which drives drive rolls bearing on the thread and feeding thread in dependence of the stepping of the motor. This also permits an adjusting of the thread consumption of a present stitch. If, i.e. the detected deviation indicates that too much thread is fed at the present stitch, the step motor can at the end of a stitch be reversed a couple of steps and thereby, through the drive rolls withdraw thread that has already been fed. However, normally the adjusting will occur by way of a control of the thread feed of a subsequent stitch in order to minimize a deviation which momentary, i.e. at present, prevails for the thread feed.

Further features of the present invention are disclosed in the subsequent detailed description, which shall be interpreted in combination with the attached drawings. It must be emphasized that the drawings are performed only for the purpose of illustration and shall not limit the invention. The drawings are not performed to scale and shows only conceptual structures and procedures described herein.

DESCRIPTION OF EMBODIMENTS

Below, a number of embodiments of the invention are described in support of the enclosed drawings.

Figure 1:
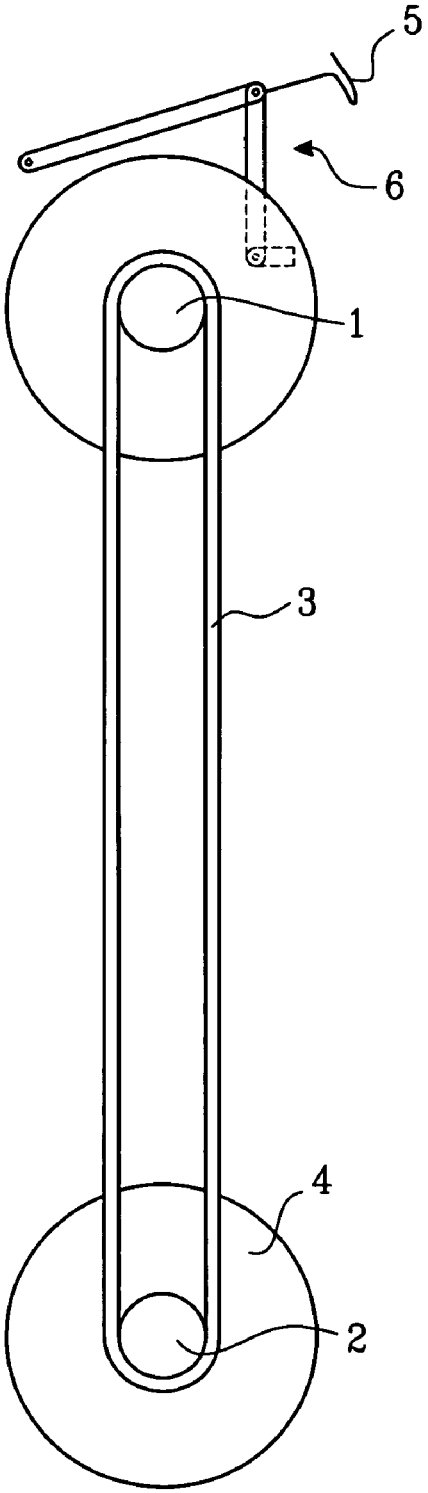
FIG. 1 schematically shows the drive of a sewing machine having two main shafts connected by means of a belt, wherein said shafts rotate one turn for each stitch that the sewing machine performs.
Figure 2:
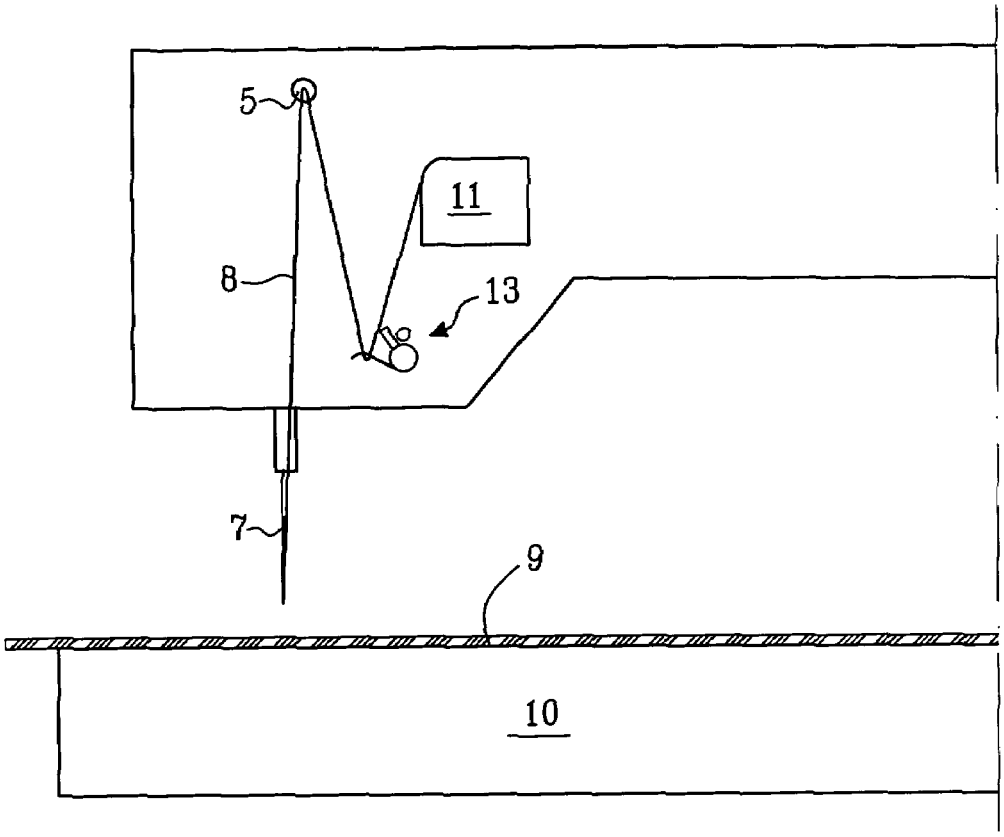
FIG. 2 shows a model view of a sewing machine having a thread transfer assembly and a time sensor for measuring the point of time of pull tight of a knot in a stitch.

In FIG. 1 there is very schematically shown a functional configuration of the drive of a sewing machine, wherein a first main shaft, denoted by 1, is driven by a drive motor (not shown). A second main shaft 2 is attached to this first main shaft 1. The second main shaft 2 is run by the first main shaft by means of a belt 3. A position sensor 4 is located on the second main shaft 2. The movement of a take-up lever 5 of the sewing machine is arranged to be carried out by means of a mechanical coupling between the first main shaft 1 and the take-up lever 5. Such a mechanical coupling is conventional and the details included in the coupling are all together indicated by the arrow 6. The first main shaft 1 is also driving a needle 7, through which an upper thread 8 is thread as is shown in FIG. 2 of the enclosed drawings.

A sewing material is transported, in a known manner, in the form of a fabric 9, between a bottom thread and an upper thread 8 for the performance of a seam, which is formed by desired stitches. According to the shown example, the fabric is conveyed across a sewing table 10, which also houses a bottom thread bobbin enclosed in a loop taker. For the realization of a stitch, in this case a lock stitch, the needle is brought to a reciprocating movement controlled by the first main shaft 1, so that the needle guides the upper thread down through the fabric, whereupon the loop taker guides the upper thread 8 about the bobbin which accommodates the bottom thread, whereby a knot is established in the fabric 9, when the needle again is brought up through the fabric and the take-up lever 5 pulls tight the knot of the stitch.

The upper thread 8 is fed via a thread transfer assembly 11, which distributes thread to the take-up lever 5 through a thread transfer spring 12, which begins to become stretched when the tensile force in the upper thread 8 exceeds a certain value.

A control program stored in a processor C is associated with the machine. The control program obtains information on the momentary rotational position of the second main shaft 2. As both of the main shafts are coupled to each other and, further, as the take-up lever 5 and the needle 7 are controlled by the movements of these shafts, the movements of the main shafts 1, 2, the take-up lever 5 and the needle 7 will be synchronized to each other in a cyclic movement pattern, whereby the control program can also obtain information on the position of the take-up lever 5 and the needle 7 of the cyclic process.

A position for any mechanical element, which takes part of the cyclic movement in the sewing machine can be detected by means of a position sensor. As one example of a position sensor, there is shown how the movement of the mentioned thread transfer spring 12 being included in a time sensor 13 is used to determine the point of time at which the thread 8 is pulled tight on the completion of a stitch. In the example, according to FIG. 3 and FIG. 4, there is shown a detector, where the angle of rotation of the second main shaft 2 of the sewing machine is utilized as that mechanical element, for which said position is detected in the form of the angle of rotation of the shaft.

When the take-up lever 5 of the sewing machine in FIG. 2 is moving upwards, the upper thread 8 will become stretched for the pull tight of the knot of an actual stitch. The angle A of rotation, for which the take-up lever 5 stretches the upper thread 8 at a correct amount of fed thread, is known. By way of detecting for which angle B of rotation the upper thread is actually stretched and then compare the actual angle B to the angle A for which the upper thread is actually stretched, a measure of the deviation between theoretical and actual thread consumption is obtained.

Figure 3:
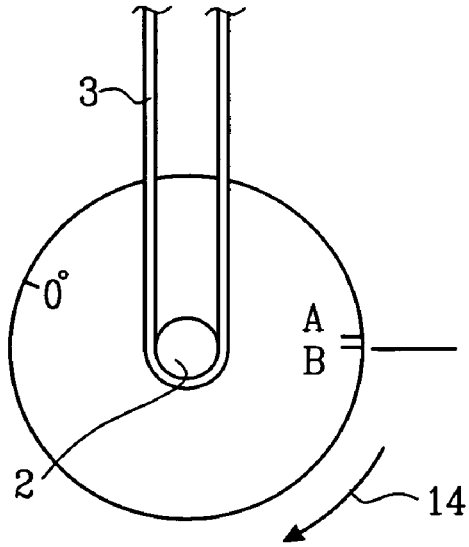
FIG. 3 illustrates the position of the actual value of a main shaft at pull tight of a knot.
Figure 4:
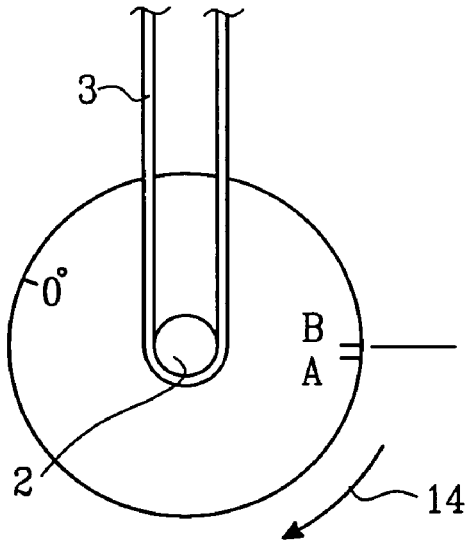
FIG. 4 illustrates the position for the set value of the main shaft according to FIG. 3 at pull tight of the knot.

In the FIGS. 3 and 4 there is symbolically shown how an actual value and a set value of the angle of rotation of the position sensor 4 can be provided. The direction of rotation is indicated through the arrow 14 and is measured, as an example, from a zero reference, which in the figure is marked by 0°. If the angle B of rotation is greater than the angle A of rotation (FIG. 3), i.e. that the thread is stretched later than desired, a smaller amount of thread than what was aimed at has been consumed. The magnitude of the angle difference A−B provides a measure of the deviation of the thread consumption. When the angle B is less than the angle A (see FIG. 4) a greater amount of thread than calculated has been consumed. The magnitude of the angle difference A−B also in this case, provides a measure of the deviation of the thread consumption but with the sign reversed. When a measure is obtained of how much the actual thread consumption deviates for the theoretically correct one and what sign the difference has, this obtained deviation can be used to compensate for the deviation by arranging the sewing machine to automatically adjust the amount of fed thread. This can be accomplished by way of using the value (and the sign) of the deviation to control the thread transfer assembly 11 by means of a correction of the theoretically processor calculated value of the thread consumption.

The detection of the position B is, according to the invention, based on the fact that the point of time for the pull tight of the knot can be determined, whereby this point of time in some way is associated to a measurable point of time of a time range, during which the pull tight of the knot occurs. Simply explained, it is required for each knot of respective stitches that a comparable value of the point of time at which the knot is pulled tight can be obtained. An example of how this can be achieved is shown by reference to FIG. 5. In said figure it is illustrated by a curve, very schematically, how the tensile force F of the upper thread of a sewing machine varies as a function of the time T. When the pull tight of the knot of a stitch is initiated the tensile force F in the upper thread rises steeply, as is evident from the figure. After the pull tight of the knot, the tensile force returns to a low value, i.e. the thread is slackened. A time sensor is arranged to determine the point of time, at which the tensile force F in the upper thread reaches a fixed value P set in advance.

Figure 6A:
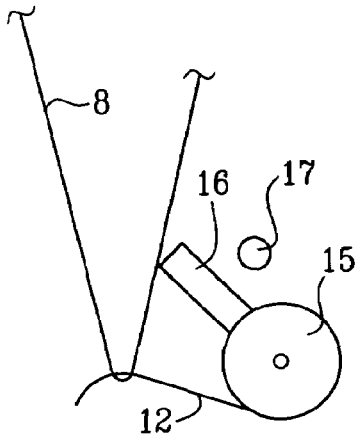
FIGS. 6*a* and 6*b* shows two different positions of the time sensor, wherein it is illustrated how a light beam is blocked by a flag at the point of time t.

The time sensor, according to one embodiment, is provided in the form of an element which is activated at the point of time t in the lapse of pull tight of the knot, when the tensile force in the upper thread reaches said in advance set value P. According to the example, the time sensor 13 includes the previous mentioned thread transfer spring 12. The time sensor 13 and its function is more clear illustrated by means of the FIGS. 6*a* and 6*b*. The thread transfer spring 12 is attached to a rotatable wheel 15. On the wheel 15 a flag 16 is attached radially outwards from the wheel. When the upper thread 8 is slackened, i.e. that the tensile force in the upper thread is small, the thread transfer spring 12 is in the position which is indicated in FIG. 6*a*. The flag 16 does not then block a light beam 17, which is emitted across the plane of the flag 16 from (a not shown) light source and is received by a light detector, which is further not shown as these devices are known in the technology.

Figure 6B:
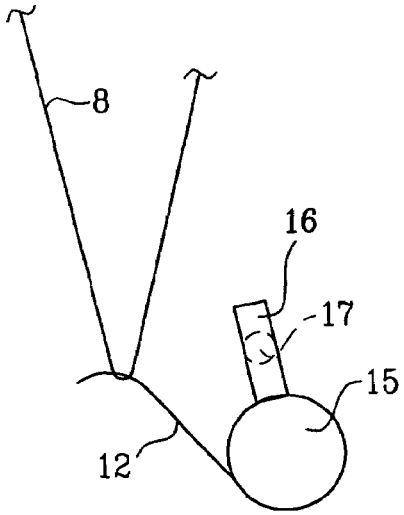

When a knot is pulled tight by means of the take-up lever 5, the tensile force in the upper thread rises rapidly, which implies that the thread transfer spring 12 is drawn upwards by the upper thread 8 according to FIG. 6*b*. When the thread transfer spring 12 in this way is drawn upwards, the wheel 15 is rotated by said spring, whereby the flag 16 is brought to a new position, where the flag blocks the light beam 17, as is shown in FIG. 6*b*. The point of time t, at which the light beam 17 is blocked, is registered by the processor of the sewing machine, whereby a detection of the position B at the pull tight of the knot of the present stitch can be performed by a reading of the angle of rotation of the position sensor 4 by means of the processor at said point of time t. The set predetermined value P of the tensile force is defined by a design of spring forces of the thread transfer spring 12 and a spring associated with the wheel 15 for back springing of the movable parts of the time sensor 13 to the position, where the tensile force in the upper thread again is small, as illustrated in FIG. 6*a*.

Time sensors of the shown kind may, of course, be established in a multiple of ways. Thus, it would be quite possible to utilize a spring loaded light wheel about which the upper thread is running and where the point of time for a displacement of the spring loaded wheel caused by the increased tensile force in the upper thread during pull tight of a knot can be detected. Every device which is used to detect a point of time for a raised tensile force in the upper thread caused by the pull tight of the knot can be used as a member for time providing, i.e. for registering of the point of time t.

Figure 5:
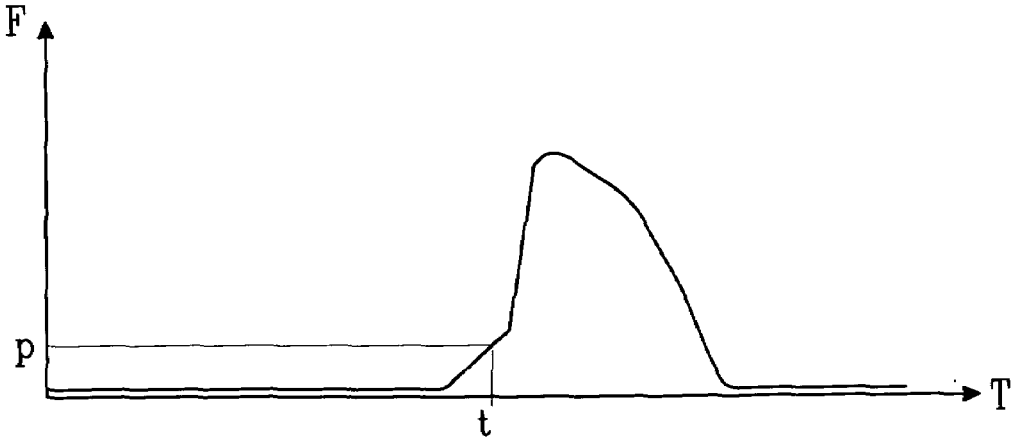
FIG. 5 illustrates a curve of the tensile force in the upper thread as a function of time, and further how the point of time t of the predetermined force P is determined.

In the sewing machine, during the sewing process, the detected value of the angle B of rotation is compared to the set value A of the angle of rotation, whereby a possible deviation is determined. In dependence of how the point of time measure is arranged to detect the value of the point of time t, a need can arise to calculate by means of the processor the amount of the remaining thread consumption during the lapse of the pull tight of the thread, which in FIG. 5 is composed of the time lapse during which the raised tensile force prevails. Such a calculation of thread consumption can be made in the processor by feeding this with parameters such as stitch length, stitch width, fabric thickness, etc. If a stiff tensile force detector is used, instead of the elastic thread transfer spring 12, the point of time t can be let to be the point of time at which the knot has become completely pulled tight, whereby any calculation of further thread consumption during the pull tight of the knot is not required.

When a measure of the deviation between A and B has been obtained, i.e. in the shown example in the form of the angle difference A−B, this measure is used to control the thread transfer assembly 11 in a direction of a minimization of the deviation during the sewing, i.e. that this angle difference is brought to zero.

The thread transfer assembly 11 is in the present example provided with selectable means for a supply of the needle 7 with a desired amount of upper thread 8. One of said means is a thread portioner. Another means is an assembly for friction braking of the upper thread 8.

Figure 7:
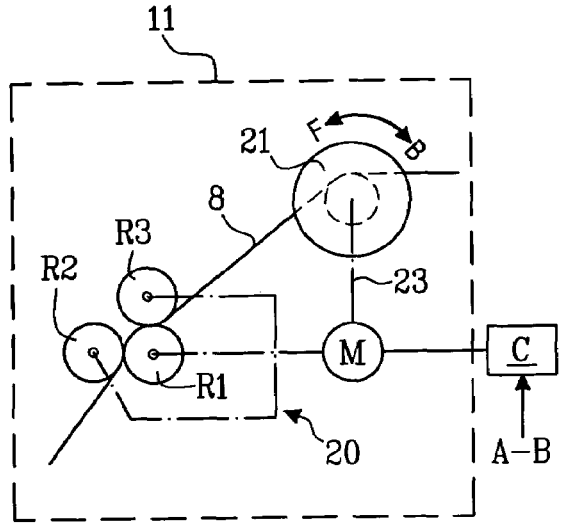
FIG. 7 schematically depicts the thread transfer assembly.

FIG. 7 schematically shows a thread portioner controlled through a processor C. Within the processor, data is stored related to the position A, at which a knot of a stitch will be pulled tight correctly. Further, the processor is continuously fed with data indicating the actual angle of rotation of the mechanical element at which the position B is measured, i.e. the set value of the angle of rotation, wherein in the present example reference is made to the angle of rotation of the second main shaft 2. Further, the processor C is arranged to control a motor M, which is mechanically coupled to 3 drive rolls R1, R2, R3 via a gear mechanism, in the figure denoted by 20. Herein, there is described an embodiment where the motor M is composed of a step motor, but other types of electric drive units, controlled in another way than by stepping, can of course be used. The upper thread 8 is conveyed through disengaged friction discs 21 between the rolls R1, R2, R3, whereby a stepping of the motor M implies that the upper thread is fed forwards to the needle 7 or backwards from the needle 7. The amount of forwards or backwards fed thread is determined by the number of steps, by which the motor is stepped. The upper thread is fed forwards when the motor is stepped in the forward direction, denoted by Forw and fed backwards when the motor is stepped backwards, denoted by Back. The feed is arranged to be controlled in dependence of value and sign of the measured deviation A−B. The magnitude of the numerical value of the deviation A−B is related to the number of steps the motor is stepped. If the deviation is positive, i.e. A−B is greater than zero, then the motor is stepped forwards. If the deviation, on the other hand, is negative, i.e. A−B is less than zero, then the motor is stepped backwards. The number of steps the motor is stepped forwards during a stitch is, of course, mainly controlled by the theoretical value (calculated by the processor) of the required feed. However, stepping backwards can be executed only in a limited number of steps.

During certain type of sewing, e.g. at free hand sewing with the sewing machine or when the operator of the sewing machine so wishes, it may be unpractical to use thread portioning out. In these matters the thread portioner can be released by disengaging the drive rolls R2 and R3, so that these are not bearing on the drive roll R1. By this, the upper thread can run freely between the drive rolls R1, R2 and R3. Hereby, the sewing machine can instead be switched to brake the upper thread 8 by means of the assembly for friction braking of the upper thread 8. A switch, not described herein, is hereby used to disengage the thread portioner and to activate the friction braking and vice versa. In an intermediate position, a neutral position, the switch is disengaging both the thread portioner and the friction braking assembly. This neutral position is used, e.g. at threading of the upper thread 8 of the sewing machine. Further, the neutral position is used as an intermediate position at transition from thread portioning out to friction braking and at a transition from friction braking to thread portioning out.

Figure 8:
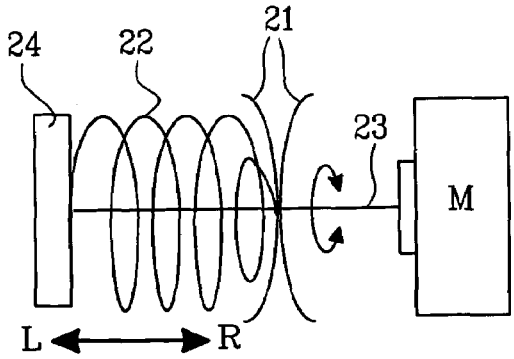
FIG. 8 shows the member for friction braking of the upper thread.

On controlling the step motor M to rotate a predetermined number of steps in the reversed direction Back, the drive rolls R1, R2, R3 are forced to be separated from each other and thus the thread portioner is disengaged, while instead a spring 22 can become stretched through a gear 23 on continued rotation in this direction of rotation (Back), as is schematically shown in FIG. 8. When the spring 22 is stretched by arranging a spring tightener 24 to be pressed in direction H by means of a force from the step motor M, the brake discs 21, used for friction braking of the upper thread 8, are brought towards each other by a greater force, whereby the brake force in the upper thread is increased. If a reduction of the brake force in the upper thread is required the step motor is rotated a number of steps in the opposite direction of rotation, i.e. in the direction Forw, whereby the thread tightener 24 due to the spring force of spring 22 is pressed in the direction denoted L. The force by which the brake discs are bearing on each other is reduced and by this the brake force of the upper thread 8 running between the brake discs 21 is reduced.

As the brake force on the upper thread 8 in the switch position for friction braking is governed by means of the direction of rotation by which the step motor M is rotated and the number of steps by which the step motor M is stepped the brake force can hence be controlled by means of control of the step motor M. On controlling the step motor M by means of the signal that is related to the measured deviation A−B, the amount of thread being required and consumed in each stitch to place the knot in the correct place in the sewing material can be controlled to mimimize the absolute value of the deviation A−B also when the thread transfer assembly 11 is in the position for friction braking of the upper thread 8. Just as in the case of the switch position, thread portioning out, this is performed by a calculation of the deviation in the processor C, whereby an error signal in a known way of automatic control engineering is sent from the processor to control the step motor M to increase or reduce the brake force on the upper thread 8, so that the deviation of the absolute value |A−B| is guided towards a minimum. If another type or motor is used instead of a step motor for the control of thread portioning out and friction braking, respectively, the control will of course be based on another motor parameter, such as number of revolutions, torque, etc.

A great advantage of the shown embodiment is that the control of thread supply at both thread portioning out and at friction braking is that the upper thread 8 can be performed with one and the same motor. A further advantage is that the shown construction makes it possible to assemble the step motor M, the thread portioning members 20, R1, R2, R3, etc., the friction braking members 21, 22, 23, 24, etc of the friction braking assembly, and the time sensor 13 in one and the same module. This modular construction cheapens the construction and makes it easy to install and to exchange the entire module as one separate and compact unit.

Of course, it is possible to perform the control of thread supplied to the needle 7 by means of separated members for thread portioning out and friction braking, wherein each member is provided with its own allotted motor for running the thread portioning out members and the running of the friction braking members, respectively.

The invention claimed is:

1. A sewing machine, comprising:

a needle;

means for supplying the needle with an upper thread;

a loop taker accommodating a bobbin for a bottom thread, wherein the needle during the cyclic movement and in cooperation with the loop taker performs stitches on a sewing material, which is transported between the upper thread and the bottom thread;

a drive unit operatively connected to the needle to move the needle in a cyclic movement;

a mechanical element operatively connected to the drive unit through coupling members to perform cyclic movements synchronous with the movement of the needle;

a take-up lever operative to complete the stitches formed in the sewing material from the upper thread and the bottom thread;

a sensor operative to detect a deviation between:

a set position of said mechanical element a point of time wherein a predetermined value of a tensile force in the upper thread is reached at the completion of the stitch and an actual position of said mechanical element at a point of time where the predetermined value of the tensile force in the upper thread is reached at the completion of the stitch; and a control operative to control said upper thread supply means to bring the deviation between the set position and the actual position to zero.

2. The sewing machine according to claim 1, wherein the sensor includes a time sensor operative to determine a point of time at which the actual value of the position of said mechanical element is read.

3. The sewing machine according to claim 2, wherein said mechanical element comprises a mechanical element selected from the group of: a first main shaft, a second main shaft, a take-up lever, the needle, a linearly movable element run by the drive unit of the sewing machine, or an element driven by the drive unit of the sewing machine to oscillate about a point of rotation.

4. The sewing machine according to claim 1, wherein said mechanical element comprises a second main shaft of the sewing machine.

5. The sewing machine according to claim 2, wherein the time sensor includes a tensile force detector operative to sense a change of the tensile force in the upper thread.

6. The sewing machine according to claim 5, wherein the tensile force detector includes a spring that is stretched by the upper thread.

7. The sewing machine according to claim 6, further comprising:

a flag operatively connected to the spring and operative to change position when the spring is stretched.

8. The sewing machine according to claim 7, wherein the time sensor includes a light beam that is blocked by the flag at a point of time when the predetermined tensile force is exceeded in the upper thread.

9. The sewing machine according to claim 8, wherein the time sensor includes a light detector operative to transmit a signal to a processor included in the control, wherein the signal comprises information about the point of time.

10. The sewing machine according to claim 9, wherein the processor is operative to read the actual position at the point of time.

11. The sewing machine according to claim 1, wherein the supply means for supplying the needle with upper thread comprises a thread transfer assembly.

12. The sewing machine according to claim 11, wherein the processor is programmed with a control program for the sewing machine.

13. The sewing machine according to claim 12, wherein the thread transfer assembly includes a step motor which is provided by the processor with a control signal for control of the thread transfer assembly such that feed of the upper thread to the needle is determined by the step motor such that the absolute value of the deviation between the set position and the actual position is minimized.

14. The sewing machine according to claim 13, wherein the thread transfer assembly includes a thread portioner operative to feed the upper thread with an amount of thread set by the processor and executed by the step motor.

15. The sewing machine according to claim 13, wherein the thread portioner includes drive rolls operative to bear on each other and the upper thread and that through a gear mechanism are run by the step motor to feed the controlled amount of thread per stitch.

16. The sewing machine according to claim 13, wherein the thread transfer assembly includes a friction brake assembly operative to friction brake the upper thread, wherein said friction braking assembly exerts a brake force on the upper thread with a brake force set by the processor and executed by the step motor.

17. The sewing machine according to claim 13, wherein the friction braking assembly includes brake discs, which through the step motor are operative to exert a predetermined brake force on the upper thread.

18. The sewing machine according to claim 16, wherein the friction braking assembly includes a spring tightener and a spring, whereby the step motor controls the spring tightener to set a spring force to the spring, such that the spring affects the brake discs to exert a brake force on the upper thread according to a calculation of the processor.

19. The sewing machine according to claim 16, wherein the thread transfer assembly including the thread portioner, the friction braking assembly and the step motor are housed in and integrated into a single module, and wherein the module can be assembled to the sewing machine or dismounted from the sewing machine as one unit.

20. The sewing machine according to claim 16, wherein the thread transfer assembly including the time sensor, the thread portioner, the friction braking assembly and the step motor are housed in a single module, and wherein the module can be assembled to the sewing machine or dismounted from the sewing machine as one unit.

21. A method of a sewing machine comprising a needle, means for supplying the needle with an upper thread, a loop taker accommodating a bobbin for a bottom thread, and a drive unit operatively connected to the needle to move the needle in a cyclic movement, the method comprising:

operatively connecting a mechanical element to the drive unit with coupling members to perform cyclic movements synchronous with the movement of the needle;

performing stitches on a sewing material with the needle during its movement in cooperation with the bobbin;

completing a stitch formed in the sewing material from the upper thread and the bottom thread;

detecting a deviation between:

a set position of said mechanical element a point of time wherein a predetermined value of a tensile force in the upper thread is reached at the completion of the stitch and an actual position of said mechanical element at a point of time where the predetermined value of the tensile force in the upper thread is reached at the completion of the stitch; and controlling said upper thread supply means to bring the deviation between the set position and the actual position to zero.

22. The method according to claim 21, further comprising:

reading with a time sensor the point of time where the predetermined value of the tensile force in the upper thread is reached at the completion of the stitch; and reading an actual value of the second position at the time of point.

23. The method according to claim 22, further comprising:

determining a point of time at a predetermined change of a tensile force in the upper thread.

24. The method according to claim 23, further comprising:

reading an angle of rotation of a main shaft of the sewing machine in relation to a reference angle with a processor of a control of the sewing machine at the point of time of the predetermined change of the tensile force in the upper thread for use as the value of the actual position.

25. The method according to claim 24, further comprising:

controlling a motor with the processor with a control signal for arranging a thread transfer assembly to supply the needle with the upper thread, such that the absolute value of the deviation between the set position and the actual position is minimized.

26. The method according to claim 25, further comprising:

controlling with the motor the thread portioner of the thread transfer assembly to deliver the upper thread to the needle in an amount which is a function of a motor parameter.

27. The method according to claim 26, wherein the motor parameter comprises a number of steps of the motor.

28. The method according to claim 25, further comprising:

controlling with the motor a brake force exerted on the upper thread by a friction braking assembly included in the thread transfer assembly to deliver the upper thread to the needle, wherein the brake force set is a function of a motor parameter.

29. The method according to claim 28, wherein the motor parameter comprises a number of steps of the motor.

30. The method according to claim 25, further comprising:

arranging the motor to be a step motor; and controlling the motor with the processor, wherein the motor is stepped a number of steps being proportional to a calculated thread consumption and the absolute value of the deviation between the set position and the actual position.

* * * * *